US008834215B2

(12) United States Patent
Wolting et al.

(10) Patent No.: US 8,834,215 B2
(45) Date of Patent: Sep. 16, 2014

(54) ELECTRICAL CONTACT ELEMENT

(75) Inventors: Thomas Wolting, Raddestorf (DE); Martin Schmidt, Luebbecke (DE)

(73) Assignee: Harting Electric GmbH & Co. KG, Espelkamp (DE)

( * ) Notice: Subject to any disclaimer, the term of this patent is extended or adjusted under 35 U.S.C. 154(b) by 141 days.

(21) Appl. No.: 13/695,852

(22) PCT Filed: Jan. 28, 2011

(86) PCT No.: PCT/DE2011/075013
§ 371 (c)(1), (2), (4) Date: Nov. 2, 2012

(87) PCT Pub. No.: WO2011/141021
PCT Pub. Date: Nov. 17, 2011

(65) Prior Publication Data
US 2013/0052888 A1 Feb. 28, 2013

(30) Foreign Application Priority Data
May 12, 2010 (DE) ..... 10 2010 020 346

(51) Int. Cl.
*H01R 9/24* (2006.01)
*H01R 13/11* (2006.01)
*H01R 13/04* (2006.01)
*H01R 4/20* (2006.01)

(52) U.S. Cl.
CPC ..... *H01R 13/04* (2013.01); *H01R 13/111* (2013.01); *H01R 4/20* (2013.01)
USPC ..... 439/884; 439/885

(58) Field of Classification Search
USPC ..... 439/877–885
See application file for complete search history.

(56) References Cited

U.S. PATENT DOCUMENTS

| | | | | |
|---|---|---|---|---|
| 4,717,352 | A | 1/1988 | De Mendez et al. | |
| 4,923,416 | A | 5/1990 | Zinn | |
| 5,653,615 | A | 8/1997 | Inaba et al. | |
| RE37,296 | E * | 7/2001 | Peterson | 439/677 |
| 7,559,779 | B1 * | 7/2009 | Caines et al. | 439/157 |

FOREIGN PATENT DOCUMENTS

| | | |
|---|---|---|
| DE | 19 92 567 | 8/1968 |
| DE | 8804092 | 6/1988 |
| EP | 0 197 821 | 10/1986 |
| GB | 346 008 | 4/1931 |
| JP | 2009-140780 | 6/2009 |

* cited by examiner

*Primary Examiner* — Khiem Nguyen
(74) *Attorney, Agent, or Firm* — Jacobson Holman, PLLC

(57) ABSTRACT

The invention relates to an electric contact element produced from a solid material, which is embodied as a plug-in contact (2*a*) or as a socket contact (2*b*), and which comprises a plug-in section (2) and a connection section (3) for contacting an electric bunched conductor, with the connection section (3) being formed as a crimped connection, and with the connection section (3) being formed as a hollow cylinder (3*a*) comprising a slot (4) in the axial direction.

10 Claims, 4 Drawing Sheets

ELECTRICAL CONTACT ELEMENT

Figure 1:
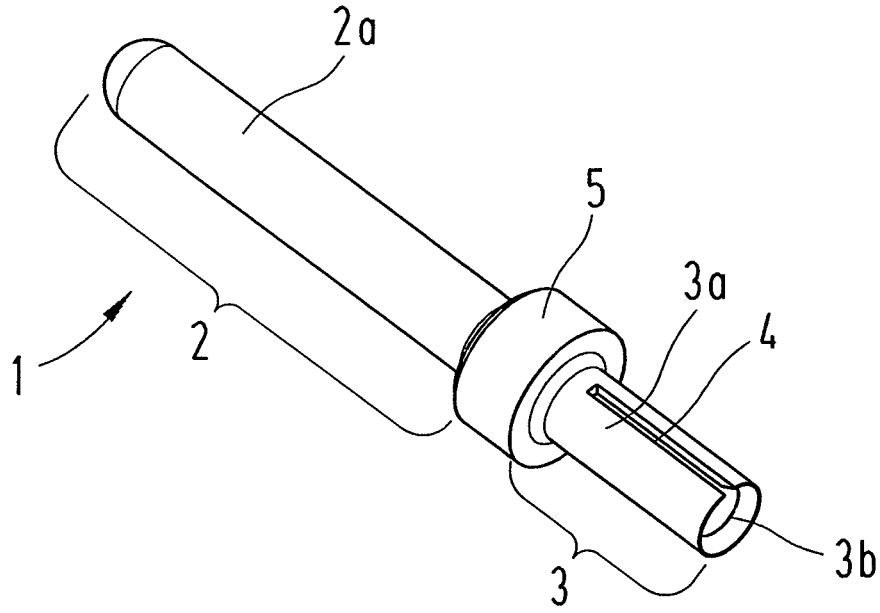

This is a national stage of PCT/DE11/075013 filed Jan. 28, 2011 and published in German, which has a priority of German no. 10 2010 020 346.7 filed May 12, 2010, hereby incorporated by reference.

The invention relates to an electric contact element, which is produced from a solid material and which is formed as a plug-in contact or as a socket contact, and which shows a plug-in section and a connection section, with the connection section being embodied as a crimped connection to contact an electric conductor.

Such contact elements are required to produce an electric connection between an electric conductor, particularly a bunched conductor, and a connection end of a plug-in or socket contact.

Frequently the connection technology of crimping is selected to connect bunched connectors to an electric contact element.

Accordingly the contact elements show at their conductive connector end an axial bore in which the insulated end of the bunched conductor is inserted and clamped tightly by way of crimping.

PRIOR ART

DE 88 040 92 U1 shows an electric contact element produced via punch-out bending technology. This electric contact element is either embodied as a plug-in or as a socket contact, with the connection of a bunched connector at the contact element occurring by way of crimping. The crimped section of the contact element is essentially embodied as a U-shaped open element. This open crimped section shows the advantage that bunched conductors with different diameters can be connected to their lack of material.

In the contact element produced by punch-out bending technology it is disadvantageous that their electric resistance is higher than in contact elements made from a solid material due to their electric resistance.

Contact elements made from a solid material are known from DE 1 992 567 A1, which show a crimped section to connect bunched conductors. Such contact elements are produced, for example, by a defined length being separated from a wire section and the contours of the contact element are produced from said wire section, e.g., by way of machining. However, in these contact elements the crimped section is embodied as a hollow cylinder with a closed jacket surface. This crimped section is only suitable for connecting an electric conductor cable of a certain diameter. For example, when connecting bunched conductors with slightly different diameters respectively different contact elements of a solid material must be used.

OBJECTIVE

The objective of the invention comprises to suggest an electric contact element showing a low electric resistance and which simultaneously being suitable to electrically contact bunched conductors of different diameters.

The objective is attained such that the connection section is formed as a hollow cylinder comprising a slot in the axial direction.

Advantageous embodiments of the invention are disclosed in the dependent claims.

As already mentioned, the electric contact element is produced from a solid material. For this purpose, for example machining is used on cam-controlled or CNC-controlled machines. However, for the slot in the connection section of the contact element cutting steps are required as well.

The contact section of the contact element may be embodied either as a plug-in contact or as a socket contact. The connection section is formed as a crimped connection, in order to allow electrically contacting, particularly bunched conductors.

In the crimping process the bunched conductors of an electrically conductive cable to be connected are inserted into the connection section formed as a hollow cylinder. The hollow cylinder is slotted in the axial direction, and thus laterally open. Using a suitable crimping tool a force is applied upon the jacket surface of the slotted hollow cylinder so that the opposite edges of the slot are bent inwardly and rolled in. Now the compacted bunched connectors of the conductive cable are located in the remaining deformed connection section of the contact element.

The slotted hollow cylinder is suitable for a crimped connection of bunched connectors of different diameters. Without the axial slot the bunched conductors with insufficient diameters would form hollow spaces in the crimped and/or connection section allowing oxidation processes to occur and negatively influencing the tensile forces of the cable.

Due to the slotted connection section of the contact elements according to the invention conductive cables of various diameters can be electrically connected. Additionally the contact element is advantageously heated to a lesser extent during the electric conduction than contact elements produced via punch-out bending technology.

In an advantageous embodiment of the invention the length of the axial slot in the connection section amounts to more than half of the length of the hollow cylinder. In other words, the hollow cylinder is slotted in the axial direction over more than half of its length. This way it is prevented that during the crimping process tears develop in the jacket surface of the hollow cylinder. Air (but also other media) can penetrate through these tears into the bunched conductors of the conductive cable. This can trigger oxidation processes worsening the electric features of the electric contact, for example the resistance.

In another advantageous embodiment of the contact element the hollow cylinder of the connection section is slotted by at least one additional slot, in addition to the axial one. This second slot is essentially aligned 90° in reference to the first, axial slot. In other words: the second slot is embodied perpendicular in reference to the first, axial slot.

In general, the base area of the hollow cylinder body is embodied circular in the connection section of the contact element. However, other geometric shapes such as rectangle, square, ellipse, or oval may also be advantageous and realized by way of using machining or cutting technology.

Advantageously an annular element is embodied between the plug-in section and the connection section. The annular element is formed disk-shaped and serves to fixate the contact element in a matching embodiment in the insulating body of a plug-in connector.

When the contact element is embodied as a plug-in connector the diameter of the disk-shaped annular element is greater than the diameter of the plug-in connector.

When the contact element is embodied as a plug-in connector, though, the diameter of the disk-shaped annular element is identical to the diameter of the socket contact.

Depending on the embodiment of the isolating body of the plug-in connector the annular element may also be formed in a different geometric shape, for example rectangular, oval, or square.

EXEMPLARY EMBODIMENT

Figure 2:
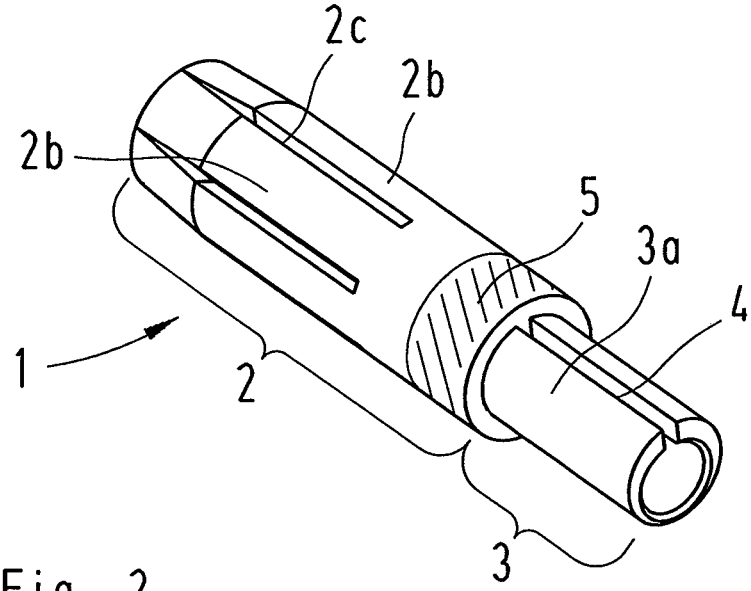
Figure 3:
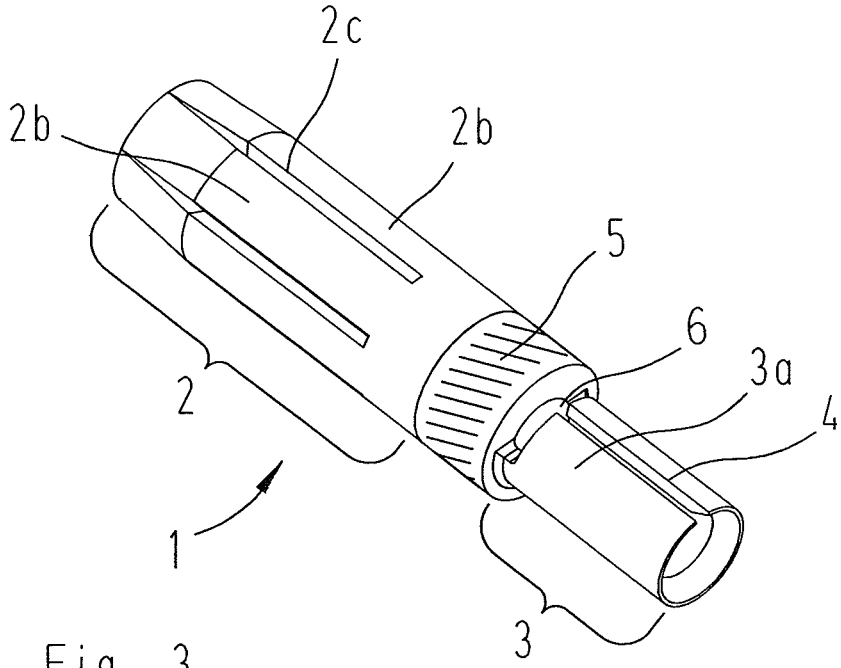
Figure 4:
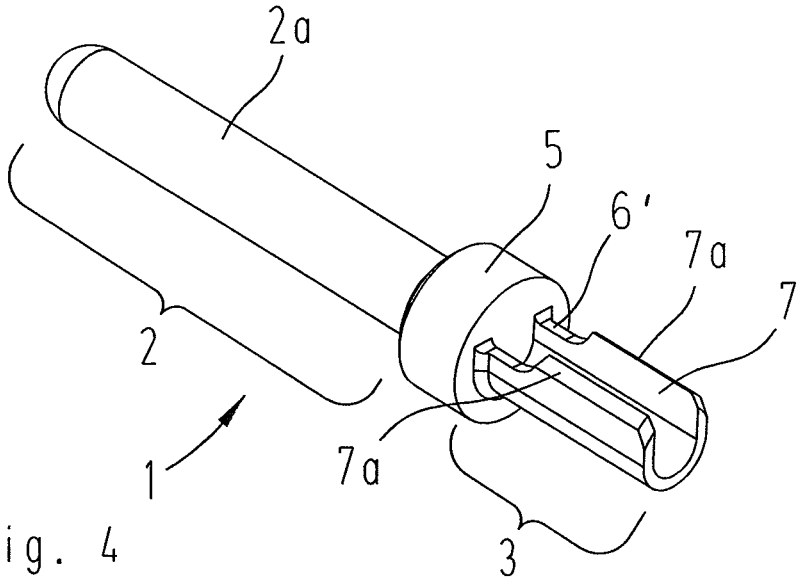
Figure 5:
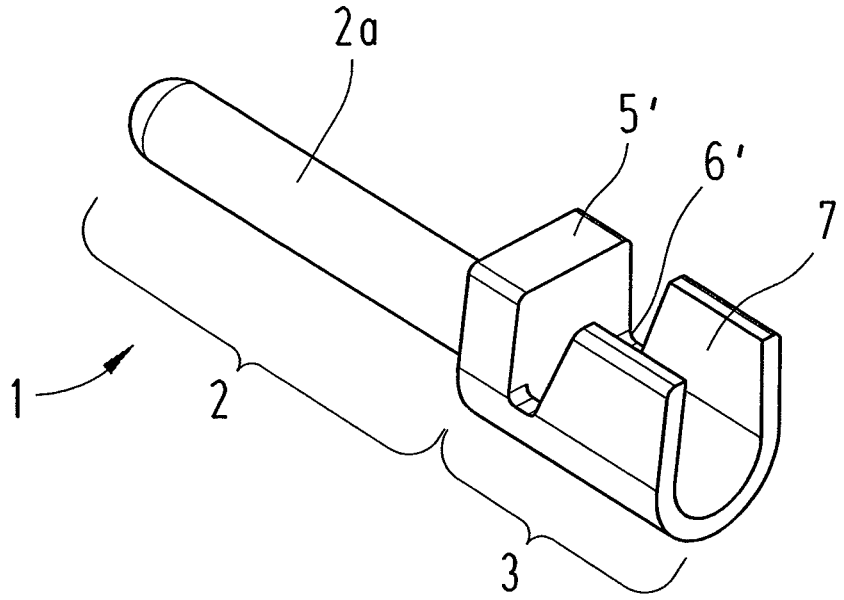
Figure 6:
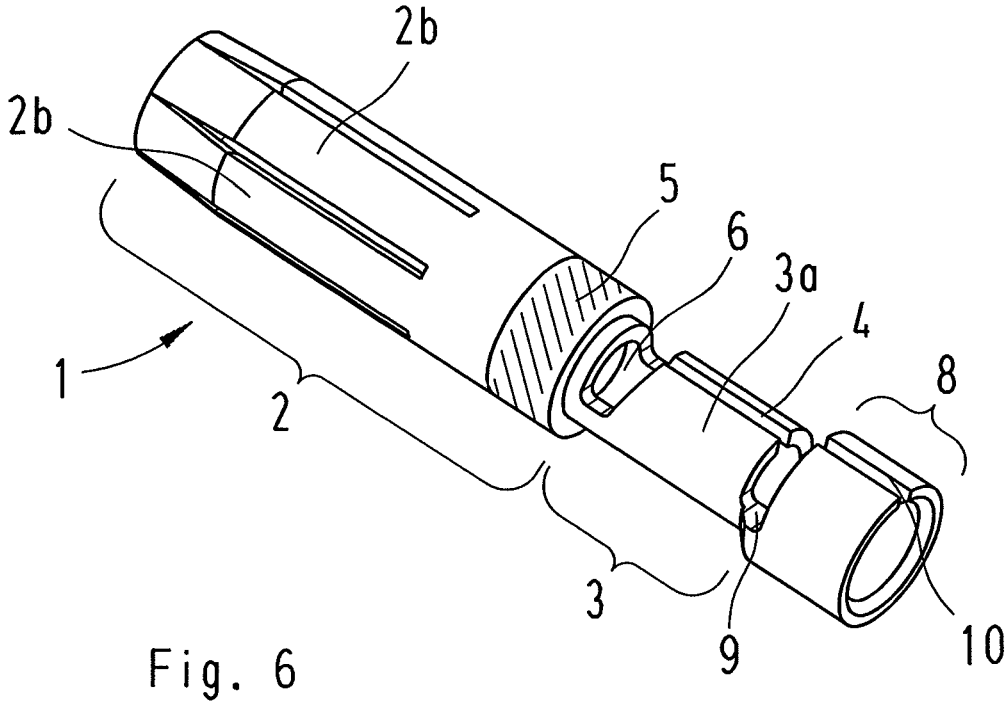
Figure 7:
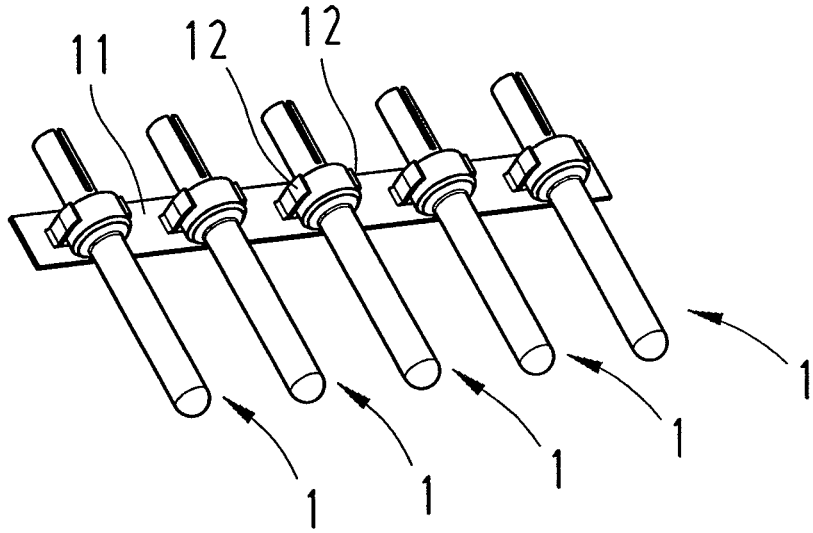
Figure 8:
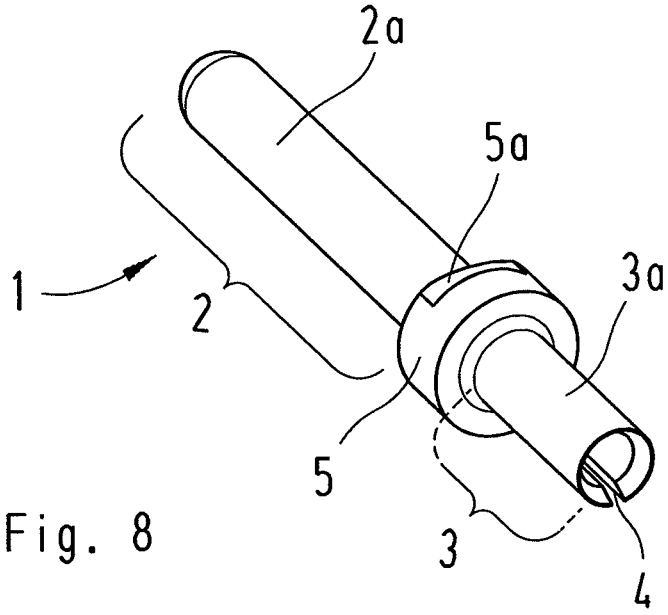

An exemplary embodiment of the invention is shown in the drawings and in the following it is explained in greater detail. It shows:

FIG. 1 a perspective illustration of a plug-in connector,

FIG. 2 a perspective illustration of a socket connector,

FIG. 3 a perspective illustration of a variant of a socket connector,

FIG. 4 a perspective illustration of a variant of a plug-in connector,

FIG. 5 a perspective illustration of another variant of a plug-in connector, FIG. 6 a perspective illustration of another variant of the socket connector, FIG. 7 a perspective illustration of a band of stringed plug-in connectors, FIG. 8 a perspective illustration of another variant of a plug-in connector.

FIG. 1 shows a perspective illustration of a plug-in connector. The contact element 1 may be divided into a contact section 2 and a connection section 3. The contact section 2 is embodied as a plug-in connector 2*a*. The connection section 3 is embodied by a hollow cylinder 3*a*, which comprises an axial slot 4. An annular element 5 is located between the contact section and the connection section. An insulating body, not shown here and provided to accept contact pins, comprises a recess into which the annular element 5 of the contact pin can be inserted. This way the contact pin is held in the insulating body.

FIG. 2 shows a perspective illustration of a socket contact. The contact section 2 is formed from a hollow cylinder, in which wedge-shaped slots 2*c* are inserted so that individual spring arms 2*b* are formed. The end sections of the spring arms are bent inwardly towards the plug-in mouth so that a circular plug-in mouth is formed. The annular element 5 shows here essentially the diameter of the socket-shaped contact section 2.

FIG. 3 shows another variant of the socket contact. Identical parts show the same reference characters. The connection section 3 of this socket contact comprises, in addition to the axial slot 4, a second slot 6 aligned essentially perpendicular in reference to the axial slot 4.

FIG. 4 shows another variant of a plug-in contact. In the connection section 3 the contact pin shows a U-profile 7. In the direction of the annular element 5 and parallel thereto a wedge-shaped slot 6' is inserted into the U-profile 7. The flanks 7*a* of the U-profile are beveled. In other embodiments the flanks 7*a* may also be parallel or inclined inwardly or outwardly.

FIG. 5 shows another variant of the plug-in contact. Identical parts show the same reference characters. Instead of an annular element 5, here the contact section and the connection section are separated via a planar element 5' embodied essentially rectangular.

FIG. 6 shows another variant of the socket contact. Identical parts here show the same reference characters. In addition to the connection section 3 for bunched connectors the contact element 1 shows a cable jacket—connection section 8. This section is also formed by a hollow cylinder showing an almost continuous axial slot 10. The diameter of the hollow cylinder of the cable jacket—connection section 8 is greater than the diameter of the hollow cylinder of the connection section 3.

The cable jacket—connection section 8 is separated from the connection section by a slot 9, extending perpendicular in reference to the axial slots 4 and 10. The insulating cable jacket of the conductive cable is fixated in the cable jacket—connection section 8. This occurs parallel in reference to the crimping process.

FIG. 7 shows one option to process the contact elements automatically, i.e. inserting them into the insulating body of the plug-in connectors. The contact elements 1 are stringed on a band 11 in snap-in clips 12 and this way they can be guided to an assembly unit. Here, the contact elements according to FIG. 1 are shown as examples. On the band 11 additionally the contact elements according to FIGS. 2 through 6 or mixtures thereof may be stringed and processed here.

FIG. 8 shows a perspective illustration of another contact element 1 embodied as a plug-in contact. A notch 5*a* is inserted into the annular element 5. A cam engages this notch 5*a* between the snap-in clips 12 of the band 11 in order for the individual plug-in contacts to be aligned homogenously on the band 12. This ensures a flawless automatic processing of the contact elements.

LIST OF REFERENCE CHARACTERS

1 contact element
2 contact section, 2*a* contact pin, 2*b* contact socket, 2*c* wedge-shaped slot
3 connection section, 3*a* hollow cylinder, 3*b* base area
4 axial slot
5 annular element, 5*a* notch
6 second slot, 6' wedge-shaped slot
7 U-profile, 7*a* edge
8 cable jacket—connection section
9 third slot
10 axial slot of the cable jacket—connection section
11 band
12 snap-in clip

The invention claimed is:

1. An electric contact element produced from a solid material, comprising a contact section (2) which is embodied as a plug-in contact (2*a*) or as a socket contact (2*b*), and a connection section (3), with the connection section (3) being embodied as a crimped connection for contacting electrical conductors, including bunched conductors of different diameters, wherein said connection section (3) is a hollow cylinder (3*a*) of uniform diameter along its entire length and formed from a solid material and including a slot (4) extending in the axial direction.

2. An electric contact element according to claim 1, characterized in that the hollow cylinder (3*a*) includes a circular base area (3*b*) at a free end of the hollow cylinder.

3. An electric contact element according to claim 1, characterized in that the hollow cylinder (3*a*) includes an elliptical base area (3*b*) at a free end of the hollow cylinder.

4. An electric contact element according to claim 1, characterized in that the length of the axial slot (4) of the hollow cylinder (3*a*) extends over more than half the length of the hollow cylinder (3*a*).

5. An electric contact element according to claim 1, characterized in that the hollow cylinder (3*a*) comprises at least one second slot (6) in addition to the axial slot (4), embodied substantially at a 90° angle in reference to the axial slot (4).

6. An electric contact element according to claim 1, characterized in that an annular element (5) is embodied between the contact section (2) and the connection section (3).

7. An electric contact element according to claim 6, characterized in that the annular element (5) is embodied disk-shaped and that the diameter of the disk-shaped annular element (5) is greater than the diameter of the plug-in contact (2*a*).

8. An electric contact element according to claim 6, characterized in that the annular element (5) is embodied disk-shaped and that the diameter of the disk-shaped annular element (5) is identical to the diameter of the socket contact (2*b*).

9. An electric contact element according to claim 6, characterized in that the annular element (5) is essentially embodied as a rectangular flat piece (5').

10. An electric contact element produced from a solid material, comprising a contact section (2) which is embodied as a plug-in contact (2*a*) or as a socket contact (2*b*), and a connection section (3), with the connection section (3) being embodied as a crimped connection for contacting electrical conductors, including bunched conductors of different diameters, and further comprising an annular element (5) embodied between the contact section (2) and the connection section (3), wherein the annular element (5) is disk-shaped and the diameter of the disk-shaped annular element (5) is greater than the diameter Of the connection section (3), wherein said connection section (3) is a hollow cylinder (3*a*) of uniform diameter along its entire length from a free end to its connection with the annular element and formed from a solid material and including a slot (4) extending in the axial direction, said slot extending over more than half the length of the hollow cylinder (3*a*), and wherein the hollow cylinder (3*a*) comprises at least one second. slot (6) in addition to the axial slot (4), embodied substantially at a 90° angle in reference to the axial slot (4).

* * * * *